US007235933B1

(12) United States Patent
So

(10) Patent No.: US 7,235,933 B1
(45) Date of Patent: Jun. 26, 2007

(54) REVERSIBLE DIMMER DEVICE OF GAS DISCHARGE LAMPS AND THE CONTROL METHOD FOR LIGHT ADJUSTING THEREOF

(76) Inventor: Yu-Sheng So, 3Fl., No.12, Alley 5, Lane 120, Bao Gao Road, Hsin-Tien City, Taipei Hsien (TW) 231

( * ) Notice: Subject to any disclaimer, the term of this patent is extended or adjusted under 35 U.S.C. 154(b) by 0 days.

(21) Appl. No.: 11/362,339

(22) Filed: Feb. 27, 2006

(51) Int. Cl.
*G05F 1/00* (2006.01)

(52) U.S. Cl. ..... 315/291; 315/307; 315/224; 315/244; 315/209 R; 315/DIG. 4

(58) Field of Classification Search ..... 315/219, 315/209 R, 244, 247, 224, 225, 291, 307, 315/312, DIG. 4, DIG. 7
See application file for complete search history.

(56) References Cited

U.S. PATENT DOCUMENTS 5,107,184 A * 4/1992 Hu et al. ..... 315/291
5,315,214 A * 5/1994 Lesea ..... 315/209 R
5,691,605 A * 11/1997 Xia et al. ..... 315/307
5,949,197 A * 9/1999 Kastner ..... 315/291
6,218,787 B1 * 4/2001 Murcko et al. ..... 315/194

* cited by examiner

*Primary Examiner*—Haissa Philogene

(57) ABSTRACT

A reversible dimmer device of gas discharge lamp and a control method for light adjusting thereof are proposed, in which a power switch on the wall or on an appliance is used to control actions of at least of a gas discharge lamp. When the power switch is turned on, a power signal is provided to drive the gas discharge lamp to produce a stable light source. The power switch is then fast pressed to make sure the times and timing of off-on switching so that a logic control circuit can output a logic control command. A frequency modulation control circuit is then used to adjust a power parameter according to the logic control command so that a variable frequency resonance drive circuit can vary the drive frequency of the power signal based on the power parameter. The gas discharge lamp can thus produce different luminance or different luminous effects.

20 Claims, 4 Drawing Sheets

REVERSIBLE DIMMER DEVICE OF GAS DISCHARGE LAMPS AND THE CONTROL METHOD FOR LIGHT ADJUSTING THEREOF

BACKGROUND OF THE INVENTION

1. Field of the Invention

The present invention relates to a reversible dimmer device more particularly relates to such a dimmer device used for at least one gas discharge lamp and a control method for light adjusting thereof, which can make use of the original power switch to directly adjust light in a smooth stage.

2. Description of Related Art

Along with promotion of living standard, the environmental design of home or company tends to be integral, convenient, and practical, among which the design of lighting plays an important role. Because gas discharge lamps such as fluorescent lamps have the advantages of long lifetime, power saving, low failure rate, high luminous quality, and high luminous efficiency, they have become the mainstream in the market.

A fluorescent lamp comprises a fluorescent lamp tube and an electronic ballast. A resonance circuit in the electronic ballast is used to generate an AC signal with a specific frequency for turning on the fluorescent lamp tube. This kind of fluorescent lamp tube, however, has only two operating modes: on and off. On the other hand, the user can control the conventional incandescent light bulb to emit light with luminance of different levels through changing the input power. Therefore, for people appreciating the life quality, the gas discharge lamps cannot fully meet various demands in different regions or at different times, and cannot further save power.

A common fluorescent lamp tube used indoors is controlled by a switch on the wall, and a desk lamp is controlled by a switch on an appliance. Although the design of fluorescent lamp tube with a smooth-stage light adjustment function has emerged, it is necessary to change the design and structure of the whole lamp or even to rearrange the wiring. This engineering is cumbersome for most users. Besides, this extra engineering will easily generate waste, hence not meeting the requirement of environmental protection. The materials and manpower required by this engineering will also increase the cost. In consideration of the above problems, the present invention proposes a reversible dimmer device of gas discharge lamp and a control method for light adjusting thereof, in which an original switch on the wall or on an appliance is used to directly carry out smooth-stage light adjustment, thereby accomplishing the convenience and flexibility in use.

SUMMARY OF THE INVENTION

An object of the present invention is to provide a reversible dimmer device of gas discharge lamp and a control method for light adjusting thereof, in which a power switch on the wall, on an appliance, on a control box, or on a console is used to switch a control command such as a light adjustment command or a mode selection command so as to adjust the luminance or the luminous mode of a gas discharge lamp in a smooth-stage way, thereby accomplishing practicability and convenience in use.

Another object of the present invention is to provide a reversible dimmer device of gas discharge lamp and a control method for light adjusting thereof, which accomplishes a wide range of application and flexible use by means of standalone adjustment, block adjustment, or group adjustment.

To achieve the above objects, the present invention provides a reversible dimmer device of gas discharge lamp, which comprises a rectifier, a power factor correction circuit, a variable frequency resonance drive circuit, a detection circuit, a logic control circuit, a frequency modulation control circuit, and a charging/discharging controller. The rectifier is connected to a power switch to rectify a power input from the power switch. The power factor correction circuit performs power factor correction and boost to the rectified power. The variable frequency resonance drive circuit produces an AC signal with a certain frequency according to the boosted power signal to drive the gas discharge lamp to function. The detection circuit is connected to the rectifier to detect the state of the power switch. The logic control circuit outputs a control command according to the times and timing of off-on switching of the power switch in a short time. The frequency modulation control circuit adjusts a power parameter according to the control command so that the variable frequency resonance drive circuit can vary the drive frequency of the power signal based on the power parameter so as to adjust the luminous mode of the gas discharge lamp. The charging/discharging controller provides a sufficient power for the variable frequency resonance drive circuit from a power storage device during switching of the power switch to prevent the gas discharge lamp from glittering due to temporary cutoff of power.

Besides, the present invention also provides a control method for light adjusting of gas discharge lamp, which comprises the steps of: turning on a power switch to provide a power signal so as to drive at least one gas discharge lamp to produce a stable light source; fast pressing said power switch if the illuminance is to be changed; outputting a logic control command according to the times and timing of off-on switching of the power switch; and modulating a power parameter of the gas discharge lamp according to the control command to change a drive frequency of the power signal so as to generate variation of luminance of the gas discharge lamp.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

The present invention provides a reversible dimmer device of gas discharge lamp and a control method for light adjusting thereof, in which a power switch on the wall, on an appliance, on a control box, or on a console is used to switch a control command such as a light adjustment command or a mode selection command so as to adjust the luminance or the luminous mode of at least one gas discharge lamp in a smooth-stage way. The gas discharge lamp can be a fluorescent lamp or another discharge lamp. Rearrangement of wiring is not required. The present invention can provide more convenient selection for users.

Figure 1:
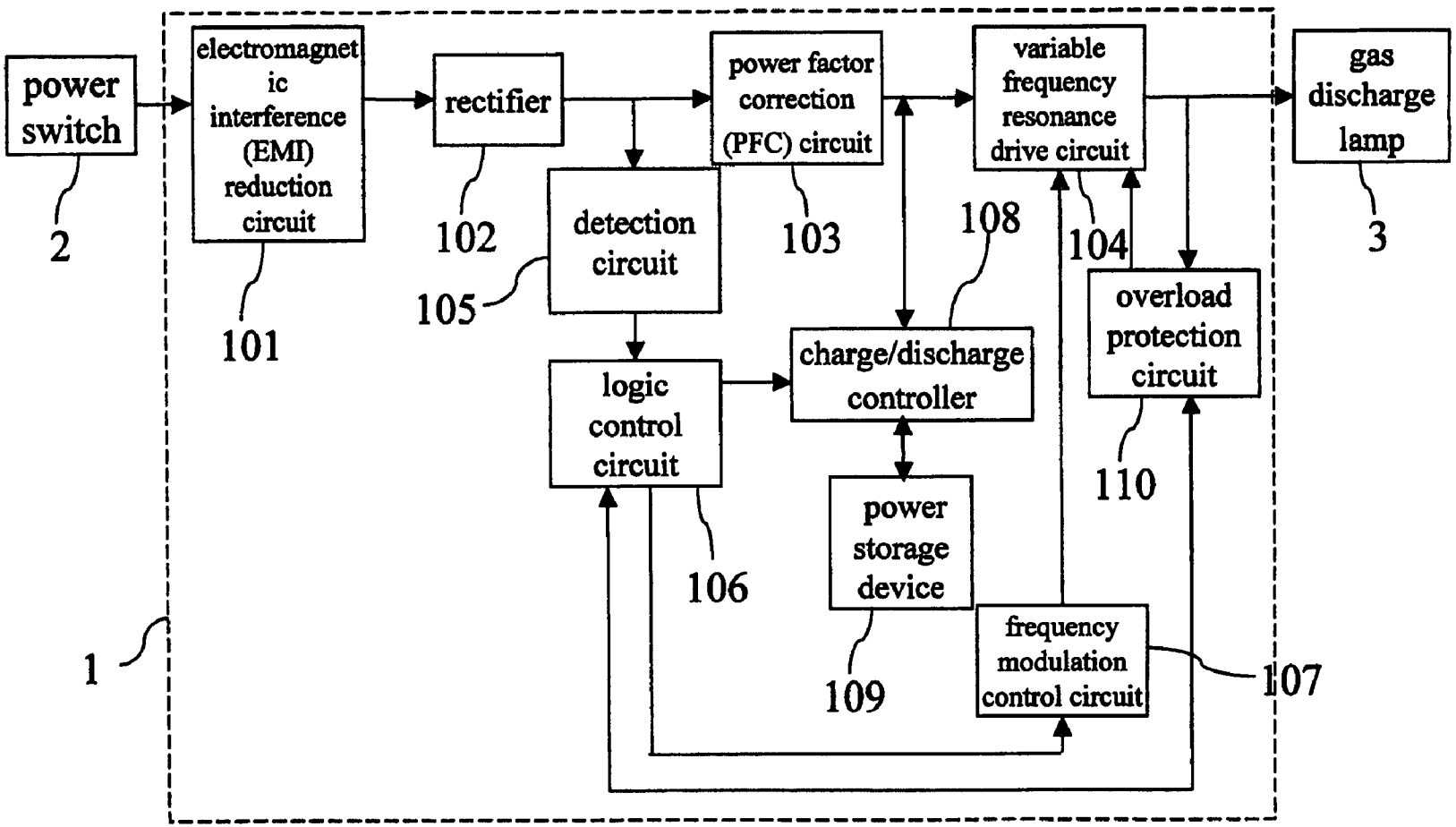
FIG. 1 is a structure diagram of a reversible dimmer device of the present invention.

As shown in FIG. 1, a reversible dimmer control device 1 makes use of a power switch 2 to control actions of at least one gas discharge lamp 3. After the power switch is turned on, the gas discharge lamp 3 keeps in a luminous mode of the previous adjustment.

An EMI reduction circuit 101, a rectifier 102, a power factor correction circuit 103, and a variable frequency resonance drive circuit 104 are connected in turn between the power switch 2 and the gas discharge lamp 3. The EMI reduction circuit is used to prevent the power from being interfered by external EMI or interfering an outside power. The rectifier 102 rectifies a power signal. The power factor correction circuit 103 performs power factor correction to the power signal and boosts the power signal to a predetermined voltage. The variable frequency resonance drive circuit then produces an AC signal with a certain frequency according to the boosted power signal to drive the gas discharge lamp 3 to emit light.

The reversible dimmer device 1 further comprises a detection circuit 105 connected to the rectifier 102. The detection circuit 105 detects the state of the power switch 102 according to the sent out power signal to know the times and timing of off-on switching of the power switch 2. A logic control circuit 106 is further connected to the detection circuit 105. The logic control circuit 106 acquires the times of high and low logic signals corresponding to the power signal according to the times of off-on switching of the power switch 2 in a short time to output a voltage or logic level signal for controlling frequency, i.e., a logic control command. The logic control command is used as a light adjustment command for light adjustment control or a mode selection command for changing the luminous mode. The logic control circuit 106 is connected to a frequency modulation control circuit 107, which adjusts a power parameter (e.g., the magnitude of current, voltage, frequency, or period) of the gas discharge lamp 3 according to the logic control command so that the variable frequency resonance drive circuit 104 can change the drive frequency according to the power parameter to adjust the luminous mode of the gas discharge lamp 3. In other words, the present invention makes use of the variation of frequency to adjust the output of power, with the frequency proportional to the output. A charging/discharging controller 108 is connected to the logic control circuit 106. The charging/discharging controller 106 provides a sufficient power for the variable frequency resonance drive circuit 104 from a power storage device 109 during switching of the power switch 2 to prevent the gas discharge lamp 3 from glittering due to temporary cutoff of power. At the initial stage when the power switch 2 is turned on, the logic control circuit 106 will first temporarily cut off the charging/discharging controller 108. After the power signal is provided to the gas discharge lamp 3 to turned it on, the charging/discharging controller 108 is then switched on to charge the power storage device 109.

Of course, in order to avoid the situation of overcurrent or overload of circuit, an overload protection circuit 110 is further connected between the logic control circuit 106 and the gas discharge lamp 3. When there is an abnormal situation of the reversible dimmer device 1 or the gas discharge lamp 3, the logic control circuit 106 can directly cut off the variable frequency resonance drive circuit 104 to stop output.

When the detection circuit 105 detects an off-on switching generated when the power switch 2 is pressed once, the logic control circuit 106 immediately drives the variable frequency resonance drive circuit 104 via the frequency modulation control circuit 107 to vary the drive frequency of the power signal based on the power parameter so as to generate variation of luminance of the gas discharge lamp 3 (i.e., the gas discharge lamp 3 automatically adjusts itself from dim to bright state or vice versa) until said power switch 2 is pressed once more or the brightest/dimmest state of the gas discharge lamp 3 is reached. Moreover, when the power switch 2 is continually pressed twice in succession to generate two off-on switching, the logic control circuit 106 will drive the gas discharge lamp 3 to adjust light in the reverse direction.

Figure 2:
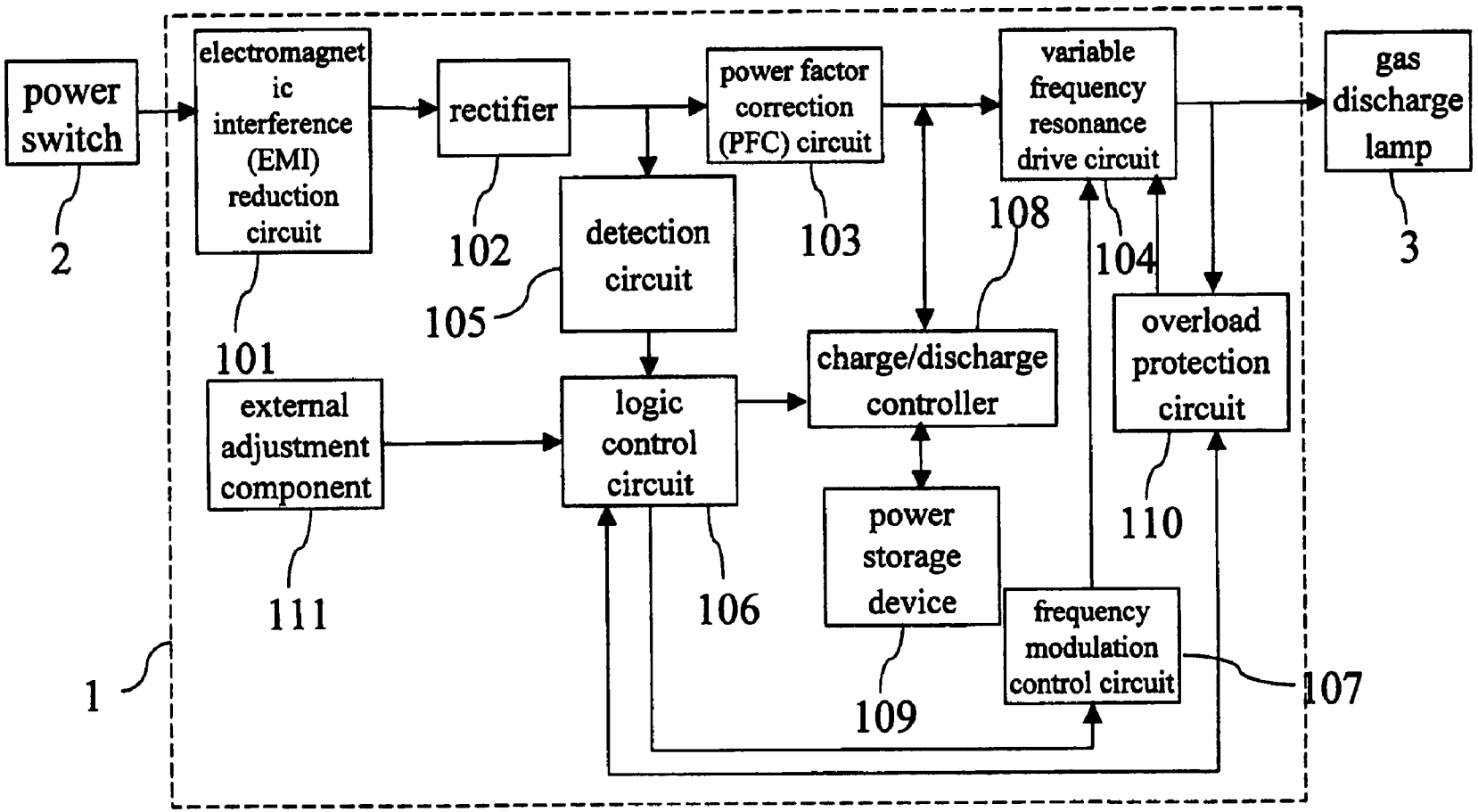
FIG. 2 is a structure diagram of a reversible dimmer device of the present invention with an additional external light adjustment component.

In addition to generating the control command directly via the power switch 2, at least an external light adjustment component 111 can be used to generate the control command. As shown in FIG. 2, the external light adjustment component 111 is connected to the logic control circuit 106 to drive the logic control circuit 106 to produce a corresponding control command. The external light adjustment component 111 can be a remote receiver, a rocker switch, a human detector, a daylight detector, or a variable resistor. When the external light adjustment component 111 is a remote receiver or a rocker switch, it can jointly control the gas discharge lamp 3 with the power switch 2 so that a user can select the power switch 2 or the remote receiver (or the rocker switch) to adjust the luminance of the gas discharge lamp 3.

Figure 3:
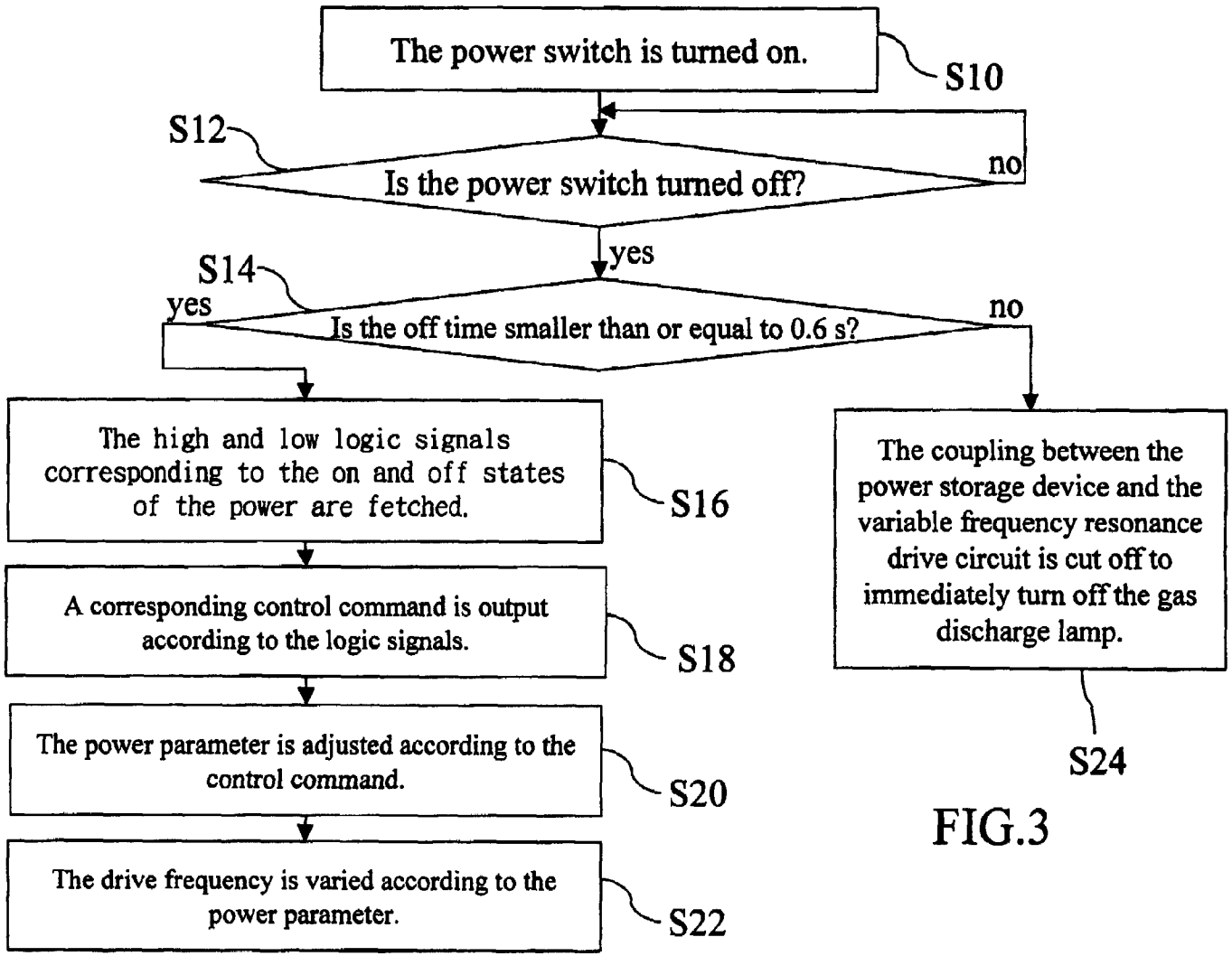
FIG. 3 is a flowchart of the control method for light adjusting of the present invention.

FIG. 3 is a flowchart of a light adjustment control method of the present invention. The light adjustment control method makes use of an original power switch on the wall, on an appliance, on a control box, or on a console to control actions of at least a gas discharge lamp. Reference is made to FIG. 3 as well as FIG. 1. The light adjustment control method comprises the following steps. First, the power switch 2 is turned on to provide a power signal for driving the gas discharge lamp 3 to produce a stable light source, and a power storage device is then used to store a standby power (when the power is just turned on, the charging/discharging controller will be temporarily cut off so that the gas discharge lamp can be immediately turned on and produce a stable light source) (Step S10). Next, the detection circuit 105 is used to detect whether the power switch 2 is off (Step S12). If the power switch 2 keeps on, Step S12 is repeated; if the power switch 2 is off, the logic control circuit 106 determines whether the off time of the power switch 2 is less than a predetermined time T, where $T \leqq 0.6$ sec (Step S14). If the off time is less than or equal to 0.6 sec, Step S16 is performed; if the off time exceeds 0.6 sec, the coupling between the power storage device 109 and the variable frequency resonance drive circuit 104 is cut off to shut the standby power so as to immediately turn off the gas discharge lamp 3, representing the power switch 2 is in the off state (Step S24).

The above predetermined time $T \leqq 0.6$ sec is adopted in a preferred embodiment of the present invention. The predetermined time T can also be set to be less than or equal to 1 sec (i.e., $T \leqq 1$ sec).

If the off time is less than or equal to 0.6 sec, the logic control circuit 106 acquires high and low logic signals corresponding to the off and on states of power (Step S16). The logic control circuit 106 then outputs a control command according to the logic signal (Step S18). The control command is a voltage or logic level signal capable of controlling frequency. Next, the frequency modulation control circuit 107 modulates a relevant power parameter (e.g., the magnitude of current, voltage, frequency, or period) according to the control command (Step S20). Finally, the variable frequency resonance drive circuit 104 changes the drive frequency according to the power parameter to drive the gas discharge lamp 3 to produce variations of luminance.

Figure 4:
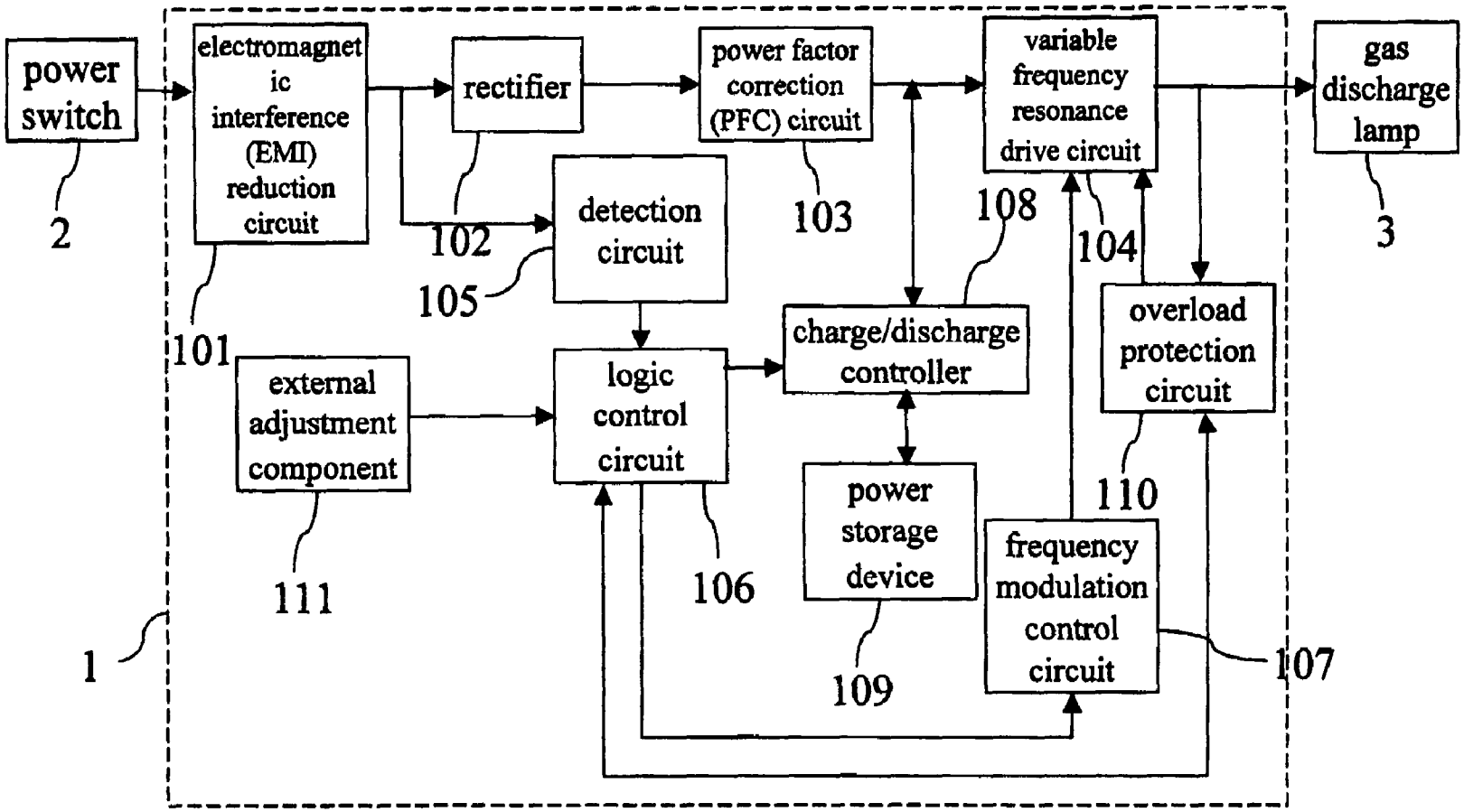
FIG. 4 is a structure diagram according to another embodiment of the present invention.

In addition to being connected to the rectifier 102 as shown in FIG. 1, the detection circuit 105 and the logic control circuit 106 can also be connected between the EMI reduction circuit 101 and the rectifier 102, as shown in FIG. 4. The state of the power switch 2 can be directly detected according to the power signal processed by the EMI reduction circuit 102. The principles and actions of the other components are the same as in FIG. 1 and thus won't be further described.

The present invention will be further exemplified below with some examples.

When the gas discharge lamp is adjusted by the power switch, the off-on switching of the power switch in a short time is used as a light adjustment command:

(1) When the gas discharge lamp is of the brightest luminance and the off-on switching occurs once, the gas discharge lamp adjusts itself from the brightest to the dimmest state unless there is an off-on signal again.

(2) If the off-on switching occurs once again before the gas discharge lamp changes from the brightest to the dimmest state, the light adjustment action stops, and the gas discharge lamp keeps at the present luminance.

(3) If the off-on switching occurs once again before the gas discharge lamp changes from the brightest to the dimmest state, the light adjustment action stops. If the adjustment goes too far and a reverse adjustment is required, the power switch is pressed twice in succession to drive the gas discharge lamp to adjust itself from dim to bright state. When the desired luminance is reached, the power switch is pressed once again to keep the gas discharge lamp at the present luminance.

(4) When the gas discharge lamp is of the dimmest luminance and the off-on switching occurs once, the gas discharge lamp adjusts itself from the dimmest to the brightest state unless there is an off-on signal again.

(5) If the off-on switching occurs once again before the gas discharge lamp changes from the dimmest to the brightest state, the light adjustment action stops, and the gas discharge lamp keeps at the present luminance.

(6) If the off-on switching occurs once again before the gas discharge lamp changes from the dimmest to the brightest state, the light adjustment action stops. If the adjustment goes too far and a reverse adjustment is required, the power switch is pressed twice in succession to drive the gas discharge lamp to adjust itself from bright to dim state. When the desired luminance is reached, the power switch is pressed once again to keep the gas discharge lamp at the present luminance.

When the power switch is used to select a different luminous mode of the gas discharge lamp, the off-on switching of the power switch in a short time is used as a mode selection command to select different chrominance or different luminance:

(1) The off-on switching of the power switch is used as a command for selecting different luminous modes.

(2) When the power is initially delivered, the reversible dimmer device is set in a preset luminous mode.

(3) When the reversible dimmer device is in the preset luminous mode and the off-on switching occurs once, the reversible dimmer device is switched to the next luminous mode. When the reversible dimmer device is in a certain luminous mode and the off-on switching occurs once, the reversible dimmer device is switched to the next luminous mode. When the reversible dimmer device is in the last luminous mode and the off-on switching occurs once, the reversible dimmer device is switched to the preset luminous mode. Moreover, different orders of mode alternation can be selected to have variation for each round so as to enhance the variation of color and luminance. This mode can also apply to the situation of KTV or concert.

Furthermore, the present invention can accomplish a wide range of application and flexible use by means of standalone adjustment, block adjustment, or group adjustment. For block adjustment, the reversible dimmer device of the present invention controls one of the gas discharge lamps as a light adjuster, and wiredly or wirelessly drives the other gas discharge lamps to function simultaneously for light adjustment. For group adjustment, the light adjustment control manner is the same as that of standalone adjustment described above.

To sum up, the present invention provides a reversible dimmer device of gas discharge lamp and a light adjustment control method thereof, in which a power switch on the wall, on an appliance, on a control box, or on a console is used to switch a control command such as a light adjustment command or a mode selection command so as to adjust the luminance or the luminous mode of a gas discharge lamp in a multi-stage way, thereby accomplishing practicability and convenience in use.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A reversible dimmer device of gas discharge lamp making use of at least one power switch to control actions of at least one gas discharge lamp, said reversible dimmer device comprising:

a rectifier connected to said power switch to rectify a power signal input from said power switch;

a power factor correction circuit connected to said rectifier to perform power factor correction and boost to said power signal;

a variable frequency resonance drive circuit for producing an AC signal with a certain frequency according to said power signal to drive said gas discharge lamp;

a detection circuit connected to said rectifier to detect the state of said power switch;

a logic control circuit connected to said detection circuit to output a control command according to the times and timing of off-on switching of said power switch in a short period;

a frequency modulation control circuit for adjusting a power parameter according to said control command so that said variable frequency resonance drive circuit can vary a drive frequency of said power signal based on said power parameter so as to adjust the luminous mode of said gas discharge lamp; and a charging/discharging controller connected to said logic control circuit, said charging/discharging controller providing a sufficient power for said variable frequency resonance drive circuit from a power storage device during switching of said power switch.

2. The reversible dimmer device as claimed in claim 1, wherein said gas discharge lamp is in a luminous mode of a previous adjustment after said power switch is turned on, when said detection circuit detects an off-on switching generated when said power switch is pressed once, said logic control circuit immediately drives said variable frequency resonance drive circuit via said frequency modulation control circuit to vary the drive frequency of said power signal based on said power parameter so as to generate variation of luminance of said gas discharge lamp until said power switch is pressed once more or the brightest/dimmest state of said gas discharge lamp is reached, and said gas discharge lamp automatically adjusts itself from dim to bright state or vice versa.

3. The reversible dimmer device as claimed in claim 1, wherein an EMI reduction circuit is further connected between said power switch and said rectifier to prevent said power from being interfered by external EMI or interfering an outside power.

4. The reversible dimmer device as claimed in claim 1, wherein said logic control circuit can directly cut off said variable frequency resonance drive circuit to stop output when an abnormal situation occurs.

5. The reversible dimmer device as claimed in claim 1, further comprising an overload protection circuit, wherein said overload protection circuit is connected between said logic control circuit and said gas discharge lamp to prevent overcurrent or overload from damaging components.

6. The reversible dimmer device as claimed in claim 1, wherein at an initial stage when said power switch is turned on, said charging/discharging controller will be temporarily cut off so that said power can activate said gas discharge lamp, and said charging/discharging controller is then switched on to carry out charging.

7. The reversible dimmer device as claimed in claim 1, wherein said logic control circuit acquires the times and timing of high and low logic signals corresponding to the off-on switching of said power to output a voltage or logic level signal whose frequency can be controlled.

8. The reversible dimmer device as claimed in claim 1, wherein said power parameter is a magnitude of current, voltage, frequency, or period.

9. The reversible dimmer device as claimed in claim 1, further comprising an external light adjustment component, wherein said external light adjustment component is connected to said logic control circuit to drive said logic control circuit to produce a corresponding control command, and said external light adjustment component can be a remote receiver, a rocker switch, a human detector, a daylight detector, or a variable resistor.

10. The reversible dimmer device as claimed in claim 1, wherein said luminous mode can be of different luminance or different luminous effects.

11. The reversible dimmer device as claimed in claim 1, further comprising a plurality of gas discharge lamps, wherein said reversible dimmer device controls one of said discharge lamps as a light adjuster, and wiredly or wirelessly drives the other of said gas discharge lamps to function simultaneously for light adjustment.

12. A control method for light adjusting of gas discharge lamp making use of a power switch to control actions of at least one gas discharge lamp, by a reversible dimmer device comprising the steps of:

turning on said power switch to provide a power signal so as to drive said gas discharge lamp to produce a stable light source and store a standby power;

detecting whether said power switch is turned on, performing the next step if the answer is yes;

determining whether the off time of said power is less than a predetermined time, cutting off said power and said standby power if the answer is no, performing the next step if the answer is yes;

acquiring a high or low logic signal corresponding to the off or on state of said power;

outputting a control command capable of controlling voltage or logic level according to said logic signal; and modulating a relevant power parameter according to said control command to change a drive frequency of said power signal to generate variation of luminance of said gas discharge lamp.

13. The control method for light adjusting as claimed in claim 12, wherein said gas discharge lamp is in a luminous mode of a previous adjustment after said power switch is turned on, and said gas discharge lamp automatically adjusts itself from dim to bright state or vice versa.

14. The control method for light adjusting as claimed in claim 12, wherein said predetermined time is less than or equal to 1 sec.

15. The control method for light adjusting as claimed in claim 12, wherein in said step of outputting a control command capable of controlling voltage or logic level according to said logic signal, a logic control circuit is used to acquire the times and timing of the high and low logic signals corresponding to off-on switching of said power so as to output a voltage or logic level signal capable of controlling frequency.

16. The control method for light adjusting as claimed in claim 12, wherein said power parameter is a magnitude of current, voltage, frequency, or period.

17. The control method for light adjusting as claimed in claim 12, wherein in said step of outputting a control command capable of controlling voltage or logic level according to said logic signal, at least an external light adjustment component can be directly used to produce a corresponding control command, and said external light adjustment component can be a remote receiver, a rocker switch, a human detector, a daylight detector, or a variable resistor.

18. A control method for light adjusting of gas discharge lamp making use of at least one power switch to control actions of at least one gas discharge lamp, said light adjustment control method comprising the steps of:

turning on said power switch to provide a power signal so as to drive said gas discharge lamp to produce a stable light source;

fast pressing said power switch to make sure the times of off-on switching so as to output a logic control command; and modulating a relevant power parameter according to said control command to change a drive frequency of said power signal to generate variation of luminance of said gas discharge lamp.

19. The control method for light adjusting as claimed in claim 18, wherein said gas discharge lamp is in a luminous mode of a previous adjustment after said power switch is turned on, and said gas discharge lamp automatically adjusts itself from dim to bright state or vice versa.

20. The control method for light adjusting as claimed in claim 18, wherein said power parameter is a magnitude of current, voltage, frequency, or period.

* * * * *